US007556208B1

(12) United States Patent
Reichel

(10) Patent No.: US 7,556,208 B1
(45) Date of Patent: Jul. 7, 2009

(54) PRE-ASSEMBLED PLATE CONSISTING OF ARMOURED CONCRETE

(75) Inventor: Dieter Reichel, Neumarkt (DE)

(73) Assignee: Max Bogl Bauunternehmung GmbH & Company KG, Neumarkt (DE)

( * ) Notice: Subject to any disclaimer, the term of this patent is extended or adjusted under 35 U.S.C. 154(b) by 33 days.

(21) Appl. No.: 10/110,098

(22) PCT Filed: Sep. 20, 2000

(86) PCT No.: PCT/EP00/09188

§ 371 (c)(1),
(2), (4) Date: Apr. 5, 2002

(87) PCT Pub. No.: WO01/25538

PCT Pub. Date: Apr. 12, 2001

(30) Foreign Application Priority Data

Oct. 6, 1999 (DE) ..... 199 48 003

(51) Int. Cl.
*E01C 11/04* (2006.01)

(52) U.S. Cl. ..... 238/8; 52/583.1; 52/223.6; 52/223.7; 52/747.12

(58) Field of Classification Search ..... 404/70, 404/47, 45; 238/2, 5, 6, 7, 8; 52/223.6, 223.7, 52/379, 383, 385, 403.1, 562, 583.1, 601, 52/602, 605, 747.12, 223.13, 223.11, 223.9, 52/414

See application file for complete search history.

(56) References Cited

U.S. PATENT DOCUMENTS 338,057 A * 3/1886 Gearon ..... 238/7

(Continued)

FOREIGN PATENT DOCUMENTS

DE 2621793 12/1977

(Continued)

OTHER PUBLICATIONS

German Patent Office, Search Report, App. No. 199 48 003.6; 4 pages, May 24, 2000; Munich, Germany.

(Continued)

*Primary Examiner*—Phi Dieu Tran A
(74) *Attorney, Agent, or Firm*—Dority & Manning, P.A.

(57) ABSTRACT

The invention relates to a pre-assembled plate consisting of armored concrete, especially for the use as a component of a solid roadway for high-speed means of transport. At least two steel rods extending in the longitudinal direction of the pre-assembled plate of armored concrete (10) and protruding over the concrete surface thereof on the front face (17) are provided. The pre-assembled plate (10) is provided with at least one, preferably several, predetermined breaking points (15) which extends crosswise in relation to the steel rods (19). The steel rod (19) is anchored in the area between the front face (17) of the pre-assembled plate (10) and the first predetermined breaking point (1) respectively and is mounted in the direction towards the respective front face (17) in the longitudinal direction thereof in an essentially freely moveable manner. According to a method for producing a plate composite structure of pre-assembled plates of armored concrete (10), the pre-assembled plate (10) is placed and exactly positioned. A casting compound (42) is underpoured under the exactly positioned pre-assembled plate. The pre-assembled plate (10) is connected to the adjacent pre-assembled plate (10) by casting the joint and connecting the steel rods (19) after the casting compound (42) has hardened.

18 Claims, 4 Drawing Sheets

U.S. PATENT DOCUMENTS

| | | | | | |
|---|---|---|---|---|---|
| 375,999 | A | * | 1/1888 | Jackson | 52/223.6 |
| 1,041,736 | A | * | 10/1912 | Caldwell | 238/8 |
| 1,279,062 | A | * | 9/1918 | Winter | 238/8 |
| 2,067,037 | A | * | 1/1937 | Alexander | 238/8 |
| 2,124,247 | A | * | 7/1938 | Fey | 238/8 |
| 2,260,657 | A | * | 10/1941 | Bohnsack | 52/223.7 |
| 2,340,263 | A | * | 1/1944 | Dodson | 52/223.7 |
| 2,611,262 | A | * | 9/1952 | Dodson et al. | 52/223.13 |
| 2,655,845 | A | * | 10/1953 | Freyssinet | 404/53 |
| 2,672,295 | A | * | 3/1954 | Cone | 238/8 |
| 2,780,150 | A | * | 2/1957 | Yeoman | 52/223.7 |
| 2,971,295 | A | * | 2/1961 | Reynolds | 52/223.7 |
| 2,984,417 | A | * | 5/1961 | Voorhees | 238/8 |
| 3,145,502 | A | * | 8/1964 | Rubenstein | 52/223.7 |
| 3,156,169 | A | * | 11/1964 | Finsterwalder | 404/70 |
| 3,173,226 | A | * | 3/1965 | Solnick | 52/89 |
| 3,234,683 | A | * | 2/1966 | Christiansen | 446/103 |
| 3,237,357 | A | * | 3/1966 | Hutchings | 52/223.6 |
| 3,237,537 | A | * | 3/1966 | Hutchings | 404/70 |
| 3,295,286 | A | * | 1/1967 | Schaich | 52/223.7 |
| 3,317,137 | A | * | 5/1967 | Harmon | 238/8 |
| 3,378,969 | A | * | 4/1968 | Larger | 52/223.7 |
| 3,596,330 | A | * | 8/1971 | Scott et al. | 24/122.3 |
| 3,621,624 | A | * | 11/1971 | Gustafson | 52/91.1 |
| 3,678,644 | A | * | 7/1972 | Wakefield et al. | 52/747.12 |
| 3,736,709 | A | * | 6/1973 | Koch et al. | 52/97 |
| 3,819,114 | A | * | 6/1974 | Bush | 238/121 |
| 3,820,293 | A | * | 6/1974 | Ohe et al. | 52/127.12 |
| 3,863,840 | A | * | 2/1975 | Szarka et al. | 238/8 |
| 3,950,465 | A | * | 4/1976 | Farahar | 264/69 |
| 3,952,468 | A | * | 4/1976 | Soum | 52/223.13 |
| 3,967,421 | A | * | 7/1976 | Dufossez | 52/146 |
| 3,996,715 | A | * | 12/1976 | Dowse | 52/591.1 |
| 4,267,085 | A | * | 5/1981 | Katoh et al. | 524/69 |
| 4,357,784 | A | * | 11/1982 | Grady, II | 52/584.1 |
| 4,500,037 | A | * | 2/1985 | Braitsch et al. | 238/2 |
| 4,633,700 | A | * | 1/1987 | Zandel | 72/455 |
| 4,648,147 | A | * | 3/1987 | Zimmermann et al. | 14/21 |
| 4,648,554 | A | * | 3/1987 | McQueen | 238/283 |
| 4,653,956 | A | * | 3/1987 | Lang | 404/28 |
| 4,703,890 | A | * | 11/1987 | Tognoli et al. | 238/7 |
| 4,905,896 | A | * | 3/1990 | Eisenmann et al. | 238/2 |
| 4,909,662 | A | * | 3/1990 | Baker | 404/31 |
| 4,911,360 | A | * | 3/1990 | Spur | 238/5 |
| 4,982,549 | A | | 1/1991 | Beck | |
| 5,163,614 | A | * | 11/1992 | Tamas et al. | 238/2 |
| 5,272,851 | A | * | 12/1993 | De La Fuente | 52/600 |
| 5,678,952 | A | * | 10/1997 | Shaw et al. | 404/62 |
| 5,924,630 | A | * | 7/1999 | Brookhart, Jr. et al. | 238/8 |
| 6,142,847 | A | * | 11/2000 | Rudy | 446/85 |
| 6,237,856 | B1 | * | 5/2001 | Bachmann et al. | 238/7 |

FOREIGN PATENT DOCUMENTS

| | | | | | |
|---|---|---|---|---|---|
| DE | 3933490 | C2 | | 4/1990 | |
| DE | 19501277 | | | 9/1996 | |
| DE | 19733909 | | | 2/1999 | |
| EP | 165856 | A1 | * | 12/1985 | |
| EP | 516612 | | * | 5/1992 | 238/8 |
| FR | 2576335 | | * | 1/1985 | 238/8 |
| GB | 2016572 | A | * | 9/1979 | |
| GB | 2169327 | A | | 7/1986 | |
| JP | 54120410 | A | * | 9/1979 | |
| JP | 272101 | | * | 11/1990 | 238/7 |
| JP | 137303 | | * | 6/1991 | 238/6 |

OTHER PUBLICATIONS

European Patent Office, International Search Report, PCT/EP00/09188, 2 pages, with English translation attached, Jan. 16, 2001; The Netherlands.

International Preliminary Examination Report, PCT/EP00/09188, 6 pages(English), Aug. 14, 2001.

* cited by examiner

PRE-ASSEMBLED PLATE CONSISTING OF ARMOURED CONCRETE

FIELD OF THE INVENTION

The invention relates to a pre-assembled plate consisting of reinforced concrete especially for use as a structural component of a permanent roadway for high-speed vehicles and to an accompanying method of installing and using the plates.

BACKGROUND OF THE INVENTION

A generic pre-assembled plate consisting of reinforced concrete is known from DE 197 33 909. The pre-assembled plate consisting of reinforced concrete is provided for constructing a compound plate construction, especially a solid roadway for high-speed rail traffic. At least two steel rods extending in the longitudinal direction of the plate and projecting over its two front sides are arranged in the pre-assembled plate consisting of reinforced concrete. Each steel rod is immovably anchored on only one position in the pre-assembled plate consisting of reinforced concrete and is otherwise freely extendable. This makes an extension stretch available that always has the length of each pre-assembled plate consisting of reinforced concrete and consequently exerts a great tensioning force on the concrete introduced into the butt joint. It turned out that this has the disadvantage that theoretical breaking points arranged at regular intervals in the pre-assembled plate consisting of reinforced concrete are bridged by the bracing and stress of the steel rods and thus loose their function. Unavoidable cracks in the pre-assembled plate consisting of reinforced concrete arise as a result at unpredictable locations, especially not in the area of the theoretical breaking points provided.

The method for producing a compound plate construction, especially a solid roadway for high-speed rail traffic that is also suggested in the DE 197 33 909 A1 consists in that at first the ends of the steel rods are frictionally and tensionally connected to each other and that thereafter the two pre-assembled plates consisting of reinforced concrete adjacent to one another are pressed apart from one another with a defined force of the steel rods. The pre-assembled plates consisting of reinforced concrete are held in this position and the entire butt joint between the two front sides adjacent to one another of the pre-assembled plates consisting of reinforced concrete is filled with a solidified filling mass. The defined force is subsequently released and the filling mass braced by the tensioning force of the steel rods that now occurs. This solution has the disadvantage that a positioning and exact adjusting of the pre-assembled plates consisting of reinforced concrete that took place prior to the application of the defined force is lost again since the complete plate must be moved for bracing. This results in a shifting of the plate on the underlying foundation, as a result of which the adjusting screws standing on the foundation are shifted or even somewhat tilted. The positioning and aligning of the pre-assembled plate consisting of reinforced concrete previously performed is distorted again as a consequence. Therefore, a new alignment of the plates is necessary after the filling of the butt joint. This necessitates an additional work expense and creates problems in the area of the filled butt joint.

DE 26 21 793 teaches a method of producing a compound grate or plate construction of pre-tensioned pre-assembled concrete parts. In this reference, the joints between the pre-assembled concrete parts are pre-tensioned after the joining together and aligning of the concrete pre-assembled parts. Tensioning member ends project from the concrete pre-assembled parts with which ends a connection is established between adjacent concrete pre-assembled parts. The joint produced is pressed apart with a pressing device, a mass is introduced into this joint as joint filling and the pressing device is not stress-relieved and removed until after the hardening or setting of the joint filling. After the setting of this mass, rod tighteners that were arranged on the tensioning member ends were tightened with a controlled force, which places the filled joints under a pre-tension. The concrete plates are subsequently underfilled or underpressed. Lastly, the recesses for the rod strainers are closed and sealed. This method has the disadvantage that the pre-tension of the tensioning rod ends is altered by the underfilling or underpressing of the concrete plates. Moreover, the adjusting is possibly influenced by this method so that a subsequent check must take place. Even different temperatures during tensioning or filling of the butt joints and during the underfilling have a negative influence on the precision of the alignment of the concrete plates.

The present invention has the problem of avoiding the disadvantages of the state of the art and in particular of assuring a precise alignment of the pre-assembled plates consisting of reinforced concrete.

This problem is solved by the features of the claims presented here.

SUMMARY OF THE INVENTION

In a pre-assembled plate consisting of reinforced concrete each steel rod is anchored in the area between the front side of the pre-assembled plate and a surface defined groove which defines the first theoretical breaking point and is supported in a substantially freely movable manner, starting from this anchoring, in the direction of the particular front side in its longitudinal direction. This assures that the theoretical breaking point is not loaded with pressure, thus possibly loosing its effect. As a result of the fact that the steel rod is movably supported in a defined area directed away from the pre-assembled plate, traction forces in a plate segment limited by the theoretical breaking point are introduced onto the pre-assembled plate containing no theoretical breaking point. This produces cracks in the area of the theoretical breaking point. This is desired since as a consequence thereof the other plate parts remain substantially free of cracks. All theoretical breaking points introduced in the pre-assembled plate can thus fulfill their task.

If the theoretical breaking point is a dummy joint running transversely to the longitudinal direction of the pre-assembled plate the theoretical breaking point can be produced in a simple manner in the casting or pouring of the pre-assembled plate already. As a result of the dummy joint the thickness of the pre-assembled plate is reduced at this position. Cracks then arise in the immediate vicinity of this dummy joint and can thus be purposefully checked for their magnitude. The state of the pre-assembled plate can thus be readily monitored.

It proved to be especially advantageous if the anchoring of the steel rod is approximately 50 cm removed from the front side of the pre-assembled plate. This yields a sufficient length of the steel rod for extending it in accordance with the requirements in a permanent joining of several pre-assembled plates. As a result of the extension a pressure force is applied to the joint that can bring about a penetration of water and therewith a destruction of the joint or of the concrete.

In order to make possible an extension of the steel rod or to prevent the steel rod from being permanently connected in the corresponding area during the manufacture of the pre-assembled plate, it is provided that the steel rod is jacketed in the area between the front side of the pre-assembled plate and the anchoring by a tube or hose, especially by a shrinkdown plastic tubing such as a heat-shrinkable sleeve. This can assure that the steel rod is arranged within the tube or hose or, if the shrinkdown plastic tubing was reduced from a greater diameter to a smaller diameter after the setting of the concrete, is movably arranged in its longitudinal direction in the pre-assembled plate. The anchor point of the steel rod is again located thereby in the first segment of the pre-assembled plate. The steel rod is to be extended from this anchor point to the end of the steel rod relative to the pre-assembled plate. A so-called tenso binding which results also yields a reliable corrosion protection in the non-concreted area.

A sliding of the steel rod within the jacketing is possible, in particular if the jacketing of the steel rod has a greater inside diameter than the outside diameter of the steel rod. The jacketing is permanently connected to the concrete thereby whereas the steel rod can rotate within the jacketing. A sliding between the concrete and the shrinkdown plastic tubing is possible if a shrinkdown plastic tubing is used.

If the steel rod ends in a pocket of the pre-assembled plate, fastening means for joining the steel rod of the one pre-assembled plate to a steel rod of the adjacent pre-assembled plate can be introduced in a simple manner. The pocket also permits the tension path of the steel rod to be sufficiently large.

If the pocket is open toward the top of the pre-assembled plate the steel rod and the end of the steel rod and fastening means connected to them can be readily accessed. Tools for tensioning the steel rod can therefore be introduced in a simple manner.

If the pocket is closed in the direction of the bottom of the pre-assembled plate the substratum can be sealed off or encased in a simple manner. The bottom of the pre-assembled plate thus forms a substantially straight line along the front side of the pre-assembled plate so that appropriate sealing means are simple to apply. Moreover, it is more readily possible with this straight-line closure edge to seal off the substratum and less sealing material is required.

If the pocket has an undercut, such as a back taper, when viewed from the top, an additional clawing of the adjacent pre-assembled plates is produced during the grouting of the pocket, e.g., with concrete. The pocket thus brings about a vertical fixing of the pre-assembled plates to each other so that an additional safeguard against an unintentional shifting of the pre-assembled plates toward each other is provided.

If the pocket of the one pre-assembled plate corresponds to a corresponding pocket of the adjacent pre-assembled plate, a wide joint is produced between the adjacent pre-assembled plates. This wide joint is for its part suited for receiving a fastener for the two pre-assembled plates and facilitates the accessibility to these fastening means during their mounting. In addition, a sufficient free space for the tensioning of the steel rods is achieved.

If a narrow joint is provided between two steel rods of the pre-assembled plate and/or toward the edge of the pre-assembled plate, a sealing compound can be introduced in a defined manner between the two pre-assembled plates.

If the bottom of the front side of the pre-assembled plate has a substantially straight-line course and/or the top has alternating narrow and wide joints, this yields on the one hand a good seal of the substratum below the pre-assembled plate and on the other hand a ready mounting of the tensioning device for the steel rods.

It is especially advantageous if a connecting means for connecting the steel rod of the one pre-assembled plate to the steel rod of the adjacent pre-assembled plate can be arranged inside the wide joint. This substantially facilitates the mounting of the pre-assembled plates. In addition, if a disassembly of the pre-assembled plate is necessary, the connection means can be accessed in a relatively simple manner.

If adjusting devices, especially spindles, are arranged on the pre-assembled plate, the pre-assembled plate can have its height precisely adjusted to the required degree. It is important, especially in the case of high-speed traffic means, that the pre-assembled plates and therewith the guide means for the high-speed vehicles are aligned very exactly with each other.

If the pre-assembled plate is manufactured from fiber concrete, a part of the traditional reinforcement can be dispensed with. Moreover, in addition to this advantage there is the further advantage of lesser crack widths.

If the narrow joint and/or the wide joint is/are filled up with a sealing compound, such as concrete applied between two pre-assembled plates, when a traction force is applied onto the steel rods, a support of the two pre-assembled plates is assured via the filled-up narrow joint. This compresses the narrow joint, reliably preventing the penetration of water into the joint.

In order to fix the fine adjustment of the pre-assembled plate a substratum mass, in particular a bituminous cement mortar, is introduced between the pre-assembled plate and the foundation. This viscous substratum mass is introduced through fill openings in the pre-assembled plate from above or laterally from the plate edge into the hollow space between the pre-assembled plate and the substratum. The hardening of this substratum mass takes place in a substantially temperature-dependent manner, that is, the pre-assembled plate hardens independently of the outdoor temperature in the position that had been precisely aligned previously. The fine adjustment of the pre-assembled plate thus remains substantially preserved.

If the substratum mass is encased in particular with a sealing element, especially with an elastic, preferably porous plastic, the need for additional expensive sealing elsewhere during the underpouring of the pre-assembled plate is avoided. The sealing element is sufficiently elastic that it nevertheless still makes contact with the bottom of the pre-assembled plate and with the top of the foundation during an adjustment in height of the pre-assembled plate for aligning the pre-assembled plate. This arrangement prevents the substratum from running out. A reliable pouring of the substratum is brought about with the aid of these especially advantageous sealing elements even in the sloped regions of the roadway.

Sealing elements have proven to be especially advantageous include a rubber or sponge mat, especially one consisting of neoprene. The elements can either be left where they are after the hardening of the substratum or can be reused when underpouring another pre-assembled plate. Moreover, the use of a sponge makes it possible that air is forced through the sponge by the sealing compound and thus does not result in inclusions under the pre-assembled plate.

If spacers are arranged in the area of the joints, a fixing of the adjacent pre-assembled plates can also take place therewith, instead of the sealing, in order to be able to tension the steel rods. The spacers can be arranged in the area of the narrow joint or of the wide joint. It is especially advantageous if the joint is poured in one piece. The spacers serve to hold the pre-assembled plates in position following the fine adjustment and both before and/or after the tensioning of the steel rods. The spacers may be wedge-shaped to facilitate adjustment to the precise interval position.

In one method in accordance with the invention a compound plate pre-assembled plates consisting of reinforced concrete with at least two steel rods extending in the longitudinal direction of the pre-assembled plate and projecting over its concrete surface on the front side and with a joint between adjacent pre-assembled plates the pre-assembled plate is first placed down and finely adjusted. The finely adjusted pre-assembled plate is then underpoured with a substratum mass and after the substratum has hardened, the pre-assembled plate is joined to the adjacent pre-assembled plate by filling up the joint and connecting the steel rods. This produces a compound plate construction that is precise in its position. Contrary to prior art methods, the individual pre-assembled plate is first brought into its exact position and substantially fixed in this position. This prevents the pre-assembled plate, once it has been aligned, from being shifted out of its position by the joining with other pre-assembled plates of the compound plate construction and thus having to readjusted. After the finely adjusted pre-assembled plate is fixed in this position it is first connected to the other pre-assembled plate. This creates a compound plate construction that is very precise in its position and is permanently fixed. During the connecting of the steel rods of adjacent pre-assembled plates the position of the pre-assembled plates. having been precisely adjusted previously, is retained since the finely adjusted pre-assembled plates had been fixed with a hardened substratum mass. This achieves an especially precise and also a rapid and therewith economical finishing of a compound plate construction that substantially renders a post-adjustment superfluous. Another substantial advantage is that if a pre-assembled plate is damaged, e.g., if a train derails, individual pre-assembled plates can be removed from a compound plate construction and replaced with a new pre-assembled plate. This achieves an assembly that is quite compatible with the method of production in accordance with the invention that has great advantages not only during the first assembly but also during repairs.

The steel rods are advantageously extended in order to connect adjacent pre-assembled plates. This creates a tension between the adjacent pre-assembled plates that assures an additional fixing in place and a water-tight connection of a joint between the pre-assembled plates.

If narrow joints and wide joints are provided at the plate joint, it is especially advantageous if the narrow joints are provided with a sealing compound at first, the steel rods are then tensioned and, finally, the wide joints are closed. This achieves a uniform loading of the pre-assembled plates and of the sealing compound.

If the steel rods are not tensioned until after the hardening of the sealing compound in the narrow joints, a pressing together of the joints between the pre-assembled plates is achieved in an advantageous manner. Any shrinking or contracting, of the sealing compound during setting is thus compensated for and a watertight connection between the pre-assembled plates is obtained.

It is especially favorable for the assembly if the steel rods of adjacent pre-assembled plates are connected by rod tensioners or strainers. The tensioners can be operated in a simple manner with a hand tool or with appropriate tool machines to impart a sufficient tension to the steel rods.

As an alternative to rod tensioners, it may be advantageous in some instances to weld the steel rods to each other. The appropriate welding methods also bring about an extension of the steel rods by heat during the welding and a resulting tension occurs when the welded rods are cooled.

Spindles have proven to be advantageous for a fine adjustment of the pre-assembled plate. Sensitive adjustment of the pre-assembled plates in the order of millimeters may be achieved with the spindles.

If concrete, especially high-grade concrete, is used as sealing compound for the joints between the pre-assembled plates a good permanence of the joint is assured.

A bituminous cement mortar proved to be especially advantageous as substratum mass. Bituminous cement mortar is viscous and is suitable for filling up the intermediate space between the pre-assembled plate and the foundation completely without bubble formation. Additionally, the bituminous cement mortar establishes a good connection to the pre-assembled plate and, moreover, to the foundation, which is frequently a hydraulically bound carrier layer or to an asphalt carrier layer. This bituminous cement mortar brings about an exact positioning of the pre-assembled plate on the foundation and fixes the pre-assembled plate, which had been adjusted prior to the introduction of the substratum mass, in its position.

If an elastic, especially a porous sealing element is used as casing for the substratum, an especially simple, economical and efficient sealing of the intermediate space between the pre-assembled plate and the foundation is obtained. The sealing element prevents the substratum from flowing out of this intermediate space. The casing can be placed before the fine adjustment, in particular before the placing of the pre-assembled plate. On account of its elasticity, it adapts precisely to the intermediate space between the pre-assembled plate and the substratum even during the fine adjusting and brings about a sealing of the hollow space.

If the pre-assembled plate is used as a carrier for rails, it has been found to be especially advantageous to brace the rails on the pre-assembled plate in rail fastenings before the fine adjustment of the pre-assembled plate. Since the proper positioning of the rails is necessary for the overall structural alignment, the rail braces and fastenings are advantageous since any imprecisions in the rail alignment can be compensated.

After the pre-assembled plate has been aligned and the steel rods connected to each other, the wide joints are closed and the rails joined to each other. After this concluding work the compound plate construction with rails is ready for high-speed rail traffic.

It is especially advantageous and an alternative to the filling up of the narrow joint before the bracing of the steel rods if the finely aligned pre-assembled plate is fixed to the adjacent pre-assembled plate with spacers, especially with wedges. following which, the joint is subsequently filled up.

If the spacers are arranged in the area of the narrow joints and/or the wide joints a good support of the spacers on the two pre-assembled plates occurs. After the joints are filled, the spacers can be relieved or removed.

Other advantages of the invention are presented in the following description of the figures.

DETAILED DESCRIPTION

Figure 1:
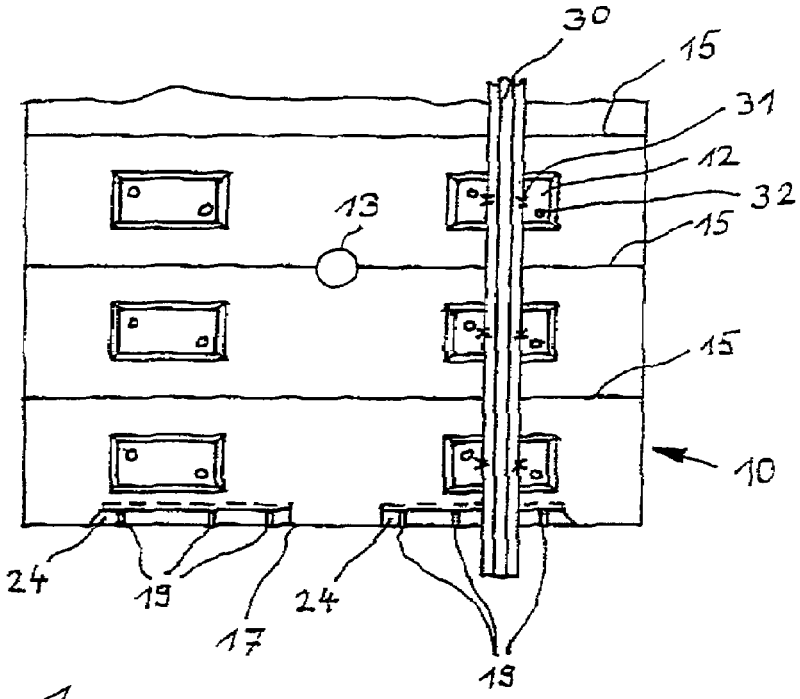
FIG. 1 shows a top view of a part of a pre-assembled plate consisting of reinforced concrete.

FIG. 1 illustrates a top view a part of a pre-assembled plate 10 consisting of reinforced concrete. Pre-assembled plate 10 consisting of reinforced concrete comprises a plurality of elevated regions 12 in this exemplary embodiment. Alternatively, a continuous band or a concrete conduit that is continuous or interrupted is also possible. Elevated regions 12 are arranged in two rows in the longitudinal direction of pre-assembled plate 10, as a result of which they can be used in the purpose shown here for fastening rails for, e.g., high-speed tracks. A rail 30 is fastened on each of the rows of elevated regions 12. Rail 30 is fastened on each elevated region 12 with a fastener 31. Fasteners 31 can be fixed as needed in prefabricated sockets 32 or in other appropriate holes.

Two elevated regions 12 are each arranged on one segment of the pre-assembled plate 10 and in the transverse direction with respect to pre-assembled plate 10. The individual segments are separated from each other by dummy joints 15. Dummy joints 15 function as theoretical breaking points in which unavoidable small cracks of pre-assembled plate 10 consisting of reinforced concrete are purposefully produced in pre-assembled plate 10. As a result of these intentional cracks, the remaining pre-assembled plate 10 consisting of reinforced concrete is substantially spared from cracks and can thus be made stable and its state can be readily checked. The design of pre-assembled plate 10 consisting of reinforced concrete is therefore selected in such a manner that the cracks occur in the area of the theoretical breaking points or dummy joints 15.

In addition to the usual reinforcement of pre-assembled plate 10, several traction or steel rods 19 are arranged in a longitudinal direction in pre-assembled plate 10. Steel rods 19, acting as traction anchor in pre-assembled plate 10, extend from one end of the pre-assembled plate to the other end of pre-assembled plate 10. Steel rods 19 project out of the concrete surface at front sides 17 of pre-assembled plate 10 and can be connected, as will be described in detail later, to the adjacent pre-assembled plate or to its steel rods.

Front side 17 comprises a substantially straight-line, continuous edge and two recesses or pockets 24 in this exemplary embodiment. Pockets 24 are setoffs in relation to straight-line front surface 17 in which setoffs steel rods 19 project out of the concrete surface. In addition, pockets 24 comprise undercuts (shown in dotted lines) that additionally improve the stability of the connection of pre-assembled plate 10 to the adjacent pre-assembled plate (not shown). Moreover, the subsequent filling up of the joints between two pre-assembled plates 10 can be achieved in a more permanent fashion since the penetration of water, among other things, is prevented by these undercuts.

Pre-assembled plate 10 comprises several filling openings 13 (only one shown here). A substratum filler is introduced under pre-assembled plate 10 in its completely aligned state through these filling openings 13.

Figure 2:
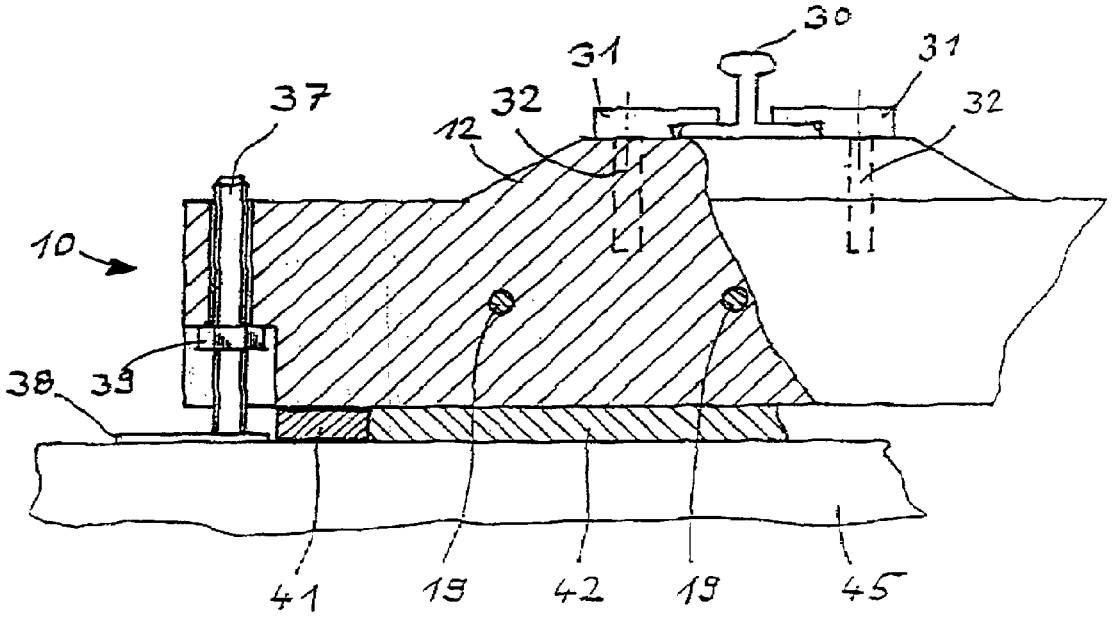
FIG. 2 shows a section transversal to the longitudinal direction of a pre-assembled plate consisting of reinforced concrete.

FIG. 2 shows a part of a section transversal to the longitudinal axis of pre-assembled plate 10 and its foundation. Elevated regions 12 are again arranged on pre-assembled plate 10 on which rail 30 is arranged with fasteners 31. Fasteners 31 are fixed in sockets 32 formed in pre-assembled plate 10. The pre-assembled plate consisting of reinforced concrete can be designed in a traditional manner with the customary reinforcement. As an alternative, it is especially advantageous if pre-assembled plate 10 is produced with reinforced concrete. Steel bars or wires that impart great strength to pre-assembled plate 10 are present in the reinforced concrete. The steel wires can be bent, wound or have some other shape with which they support the interlacing in the concrete. This makes it possible to obtain an extremely solid reinforced concrete for pre-assembled plates 10, which display an especially great strength and service life in particular in the edge areas or in the areas in which fastenings 31 are fixed.

Several spindles 37 are arranged on pre-assembled plate 10 for aligning pre-assembled plate 10 into the required position. Spindle 37 is supported upon plate 38 in order to provide a solid and uniform foundation which permits a fine adjustment of plate 10 in its height. Spindle 37 extends in this construction through a recess in pre-assembled plate 10 in order to permit a large adjustment path. Pre-assembled plate 10 is brought into its position by adjusting screw 39 on spindle 37. Before pre-assembled plate 10 is placed on a hydraulically bound carrier layer 45, elastic casing 41 is placed in the edge area of pre-assembled plate 10. This casing 41 serves to prevent underfilling 42 poured under pre-assembled plate 10 after it had been aligned from running out. The preferably viscous substratum 42 is held under pre-assembled plate 10 by casing 41. Casing 41 is preferably an elastic or plastic material. In particular, spongy materials with coarse pores or neoprene or similar plastics have proven to be advantageous. Casing 41 can either remain at this position after the substratum has hardened and thus provide a certain protection against moisture. If the casing is to be used for more substrata, it is also possible to remove this casing 41 from the pre-assembled plate 10 out and reuse it.

The individual steps of the joining of two pre-assembled plates 10 is described in the following with reference made to FIGS. 3*a* to 3*d*. At first, pre-assembled plates 10 are precisely aligned in their height by spindles 37 and nuts 39. Steel rods 19 of the two pre-assembled plates to be connected are substantially aligned in their longitudinal axis (FIG. 3*a*). Substratum 42 is subsequently poured under pre-assembled plate 10 via filling openings 13. Substratum 42 preferably consists of a bituminous mortar concrete. Substratum 42 joins pre-assembled plate 10 to hydraulically bound carrier layer 45 prepared below it. When substratum 42 has completely hardened, narrow joints located between the two plates 10 are filled up with a sealing compound, preferably concrete (FIG. 3*b*). The pouring can take place solely in the area of joint abutments 21 of pre-assembled plate 10 or also fill up the lower area between pre-assembled plates 10 in which wide joints 27 following above are located. As soon as the sealing compound has hardened, steel rods 19 are connected to each other by tighteners 28 and extended. This produces a pressure on sealing mass 25 in narrow joints 26 and thus effectively prevents the entry of water. It is noted that the precise alignment of pre-assembled plates 10 previously carried out during the tensioning of steel rods 19 is not altered by this procedure since the pre-assembled plates are supported on sealing compounds 25 and are fixed with respect to the foundation by substratum 42 (FIG. 3*c*).

Figure 3D:
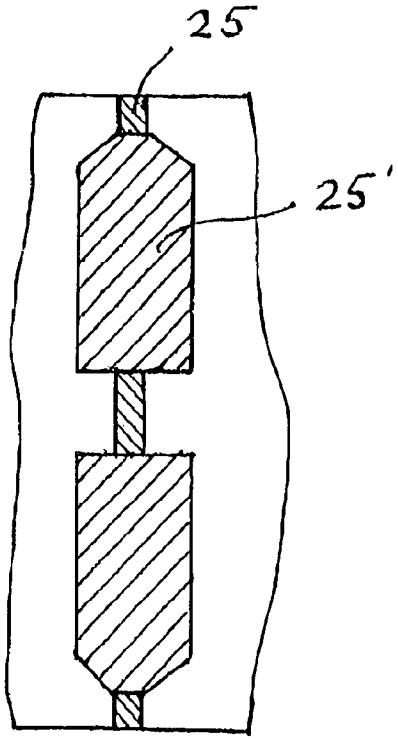
FIGS. 3*a* to 3*d* show different method steps in the joining of two pre-assembled plates consisting of reinforced concrete.

After steel rods 19 have been connected to each other and extended, the wide joint 27 can be closed in order to prevent corrosion (FIG. 3*d*). The closure can also take place by introducing a sealing compound 25, e.g., concrete. Alternatively, a removable covering can also be provided here. However, a firmer joining of the two pre-assembled plates 10 takes place by filling up wide joint 27 since this brings about an additional cogging of pre-assembled plates 10 given a corresponding shape of wide joint 27.

The procedure for the joining of the two pre-assembled plates 10 was presented in FIGS. 3*a* to 3*d* without a built-on rail 30. If the pre-assembled plates are used for high-speed rail traffic, it is advantageous if rail 30 has already been built on for the aligning of pre-assembled plates 10 since rail 30 is decisive for the aligning of pre-assembled plates 10.

Figure 3C:
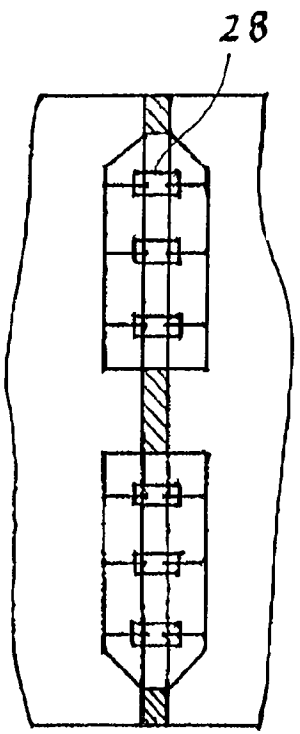
Figure 3B:
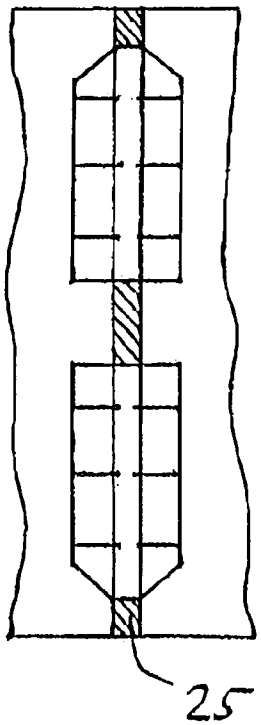
Figure 3A:
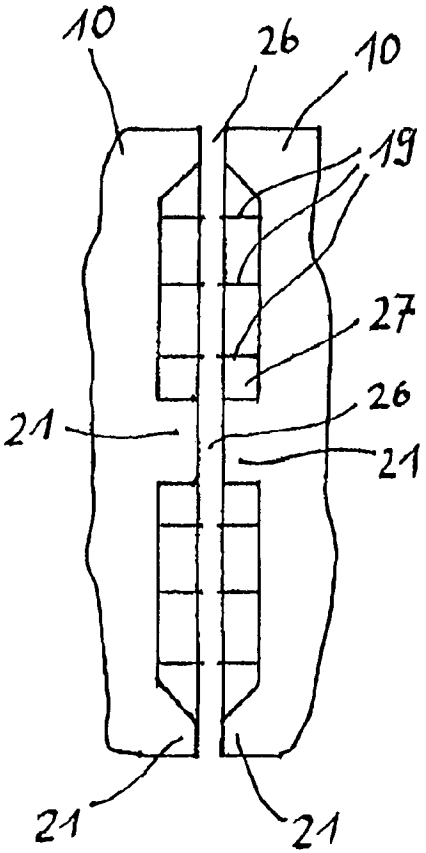
Figure 4:
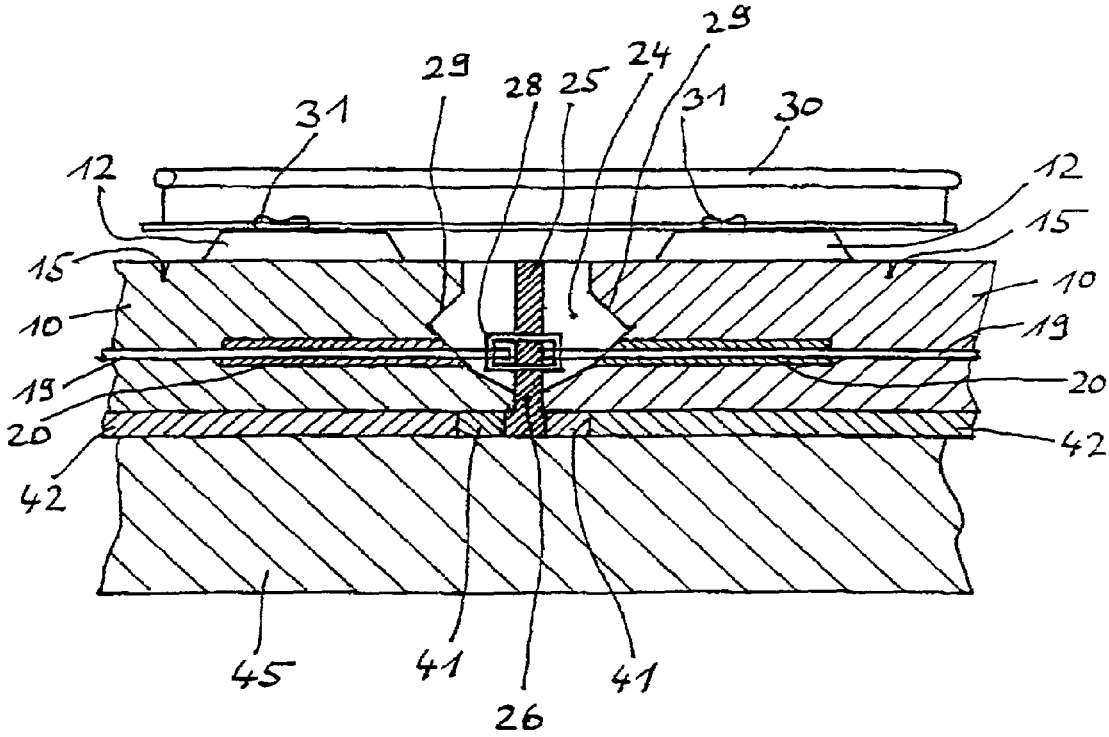
FIG. 4 shows a detailed view in longitudinal section of a pre-assembled plate consisting of reinforced concrete in accordance with FIG. 3*c*.

FIG. 4 shows the joint of two pre-assembled plates 10 prepared up to the work step of FIG. 3*c* in more detail. The pre-assembled plates 10 are cut lengthwise in the area of steel rods 19. Pre-assembled plates 10 are arranged on substratum 42 that is supported on a hydraulically bound carrier layer. Casing 41 prevents substratum from breaking out of the area of pre-assembled plate 10 during the underpouring or underpressing of pre-assembled plate 10.

Pre-assembled plate 10 comprises elevated regions 12 on which rail 30 is fastened with fastenings 31. Dummy joints 15 are arranged at regular intervals in pre-assembled plates 10 and represent theoretical breaking points for pre-assembled plate 10. Several steel rods 19 have been introduced into pre-assembled plate 10. Each steel rod 19 has opposed ends. Each steel rod 19 has one of its opposed ends projecting from the first front side 17 of the plate 10 and the other of its ends projecting from the second or opposite front side 17 of the plate 10. Each rod 19 has a first near end portion that extends within the plate 10 over a distance that extends substantially from the undercut 29 of the pocket 24 in the first front side and terminates longitudinally before the first transverse groove that forms a dummy joint 15. As shown in FIG. 4 for example, a tube 20 surrounds each first near end portion of each rod 19. Similarly, each rod 19 has a second near end portion on the other side of rod 19 from the first near end portion. Each rod 19 defines an intermediate portion that is secured to the plate 10 and that is between the first near end portion and the second near end portion. Thus, each steel rod 19 is substantially firmly anchored in pre-assembled plate 10. However, each steel rod 19 is not connected to the concrete of the pre-assembled plate only in the area from dummy joint 15 to the end of the particular pre-assembled plate 10 and can thus be freely extended. To this end steel rod 19 is in a tube 20 that prevents a connection of steel rod 19 with a sealing compound 25. Narrow joints 26 are filled up with sealing compound 25. Steel rods 19 are connected to each other by tightener 28 and extended. The extension brings it about that the steel rods are extended in their freely movable area in the particular tube 20 and thus effect a pre-tensioning. Sealing compound 25 is pressed and the composite construction stabilized by the pre-tension so that the penetration of water into the joints is prevented. In addition, pre-assembled plates 10 are pressed firmly against each other via sealing compound 25. The fact that steel rod 19 is movably supported only in the area between dummy joint 15 and the end of pre-assembled plate 10 brings it about in a reliable manner that dummy joint 15 is not bridged with a pressure force and loses its function therewith. The force on the concrete body is introduced only in the last segment, namely, between dummy joint 15 and the end of pre-assembled plate 10 via steel rods 19.

If pocket 24, in which tighteners 28 and the ends of steel rod 19 are located, is designed so that it has an undercut 29 in a top view onto the plate, an additional cogging of pre-assembled plates 10 with each other is achieved if wide joint 27 formed by pockets 24 is filled up with sealing compound 25'. Pre-assembled plates 10 are additionally hindered therewith from moving vertically.

Substratum 42 can be removed again in the instance in which the plate or the substratum lowers in the course of the using of the plate. This happens in that substratum 42 is bored through transversely to the longitudinal direction of the plate. A saw, especially a saw cable, is introduced into the borehole and saws through the substratum under the plate. The plate can then be precisely realigned, e.g., with spindles, and more matter can be poured under it again.

Figure 5:
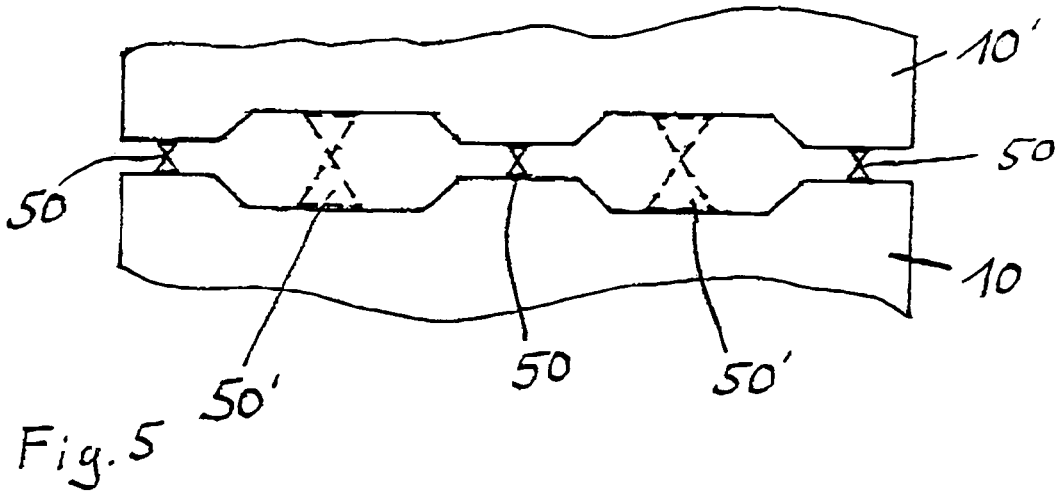
FIG. 5 shows a butt joint with spacers.

FIG. 5 shows a top view onto a butt joint between two pre-assembled plates 10 and 10': Spacers 50 are arranged for fixing pre-assembled plates 10 and 10'. Spacers 50 are located in the area of a narrow joint. Alternatively or additionally, two spacers 50' can be provided in the area of the wide joints. It is assured in each of the embodiments that the finely aligned state of pre-assembled plates 10 and 10' is retained during the tensioning of the steel rods.

Figure 6:
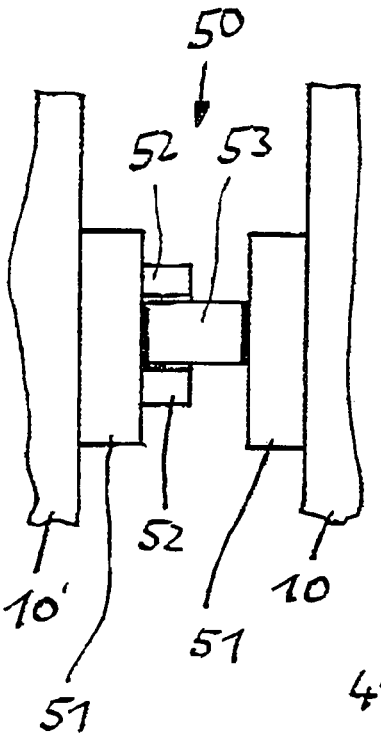
FIG. 6 shows a spacer in a top view.

FIG. 6 shows a top view onto a spacer 50. Spacer 50 consists of base plate 51 fastened on pre-assembled plate 10 and 10'. This base plate 51 can either be cast in pre-assembled plate 10, 10' or have been subsequently applied. One of base plates 51 comprises guides 52 for a wedge 53. Wedge 53 is introduced into guides 52 between the two base plates 51 when pre-assembled plates 10 and 10' have been aligned. This fixes the interval of pre-assembled plates 10 and 10' so that during a tensioning of the steel rods the pre-assembled plates 10 and 10' can not move toward one another and the alignment of the plates is not changed.

Figure 7:
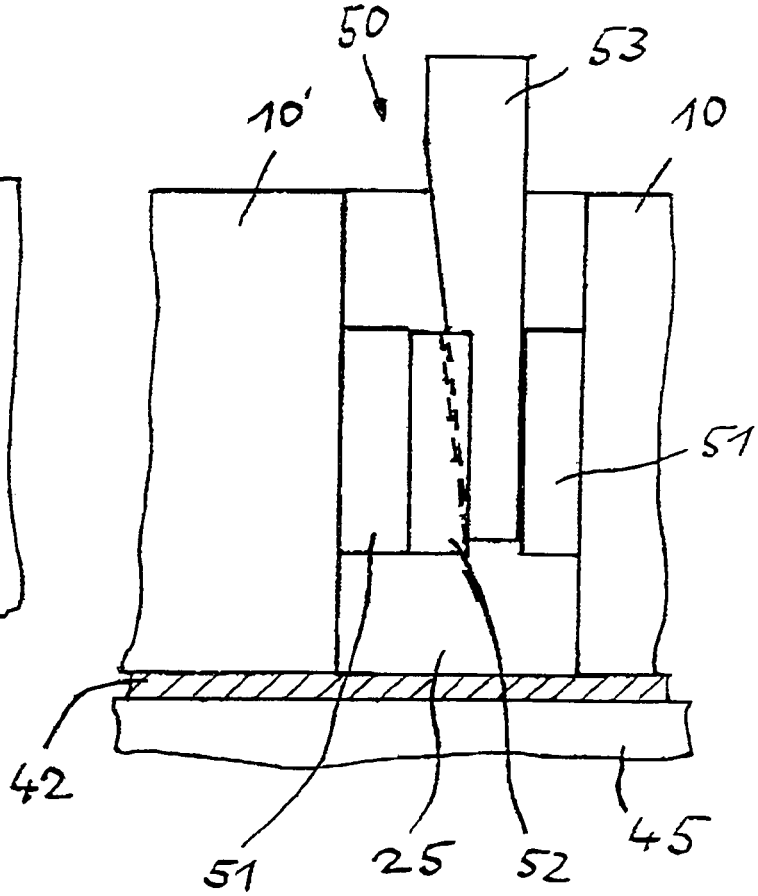
FIG. 7 shows a spacer in a lateral view.

FIG. 7 shows a lateral view of spacer 50. Pre-assembled plates 10, 10' located on substratum 42 or carrier layer 45 are held at a defined interval by wedge 53. This interval is permanently fixed after the bracing of the steel rods in that the joint is filled up with sealing compound 25. After the hardening of sealing compound 25 the position of pre-assembled plates 10, 10' to one another is permanently determined. Wedge 53 can be removed as needed and used for the next butt joint. In a special embodiment sealing compound 25 can also be hollowed out at least temporarily in the area of spacer 50. After the hardening of the rest of sealing compound 25 the complete spacer 50 can be removed from the butt joint together with wedge 53 and used for another connection position.

The use of the spacers permits an immediate application of tractive force on the steel rods and a subsequent common sealing of the wide and of the narrow joint. This is especially advantageous if unfavorable temperature and climate conditions for the sealing of the joint are present. A more favorable temperature and a suitable climate can be waited for the final filling up of the wide and of the narrow joint so that an optimum processing of the material is given.

The present invention is not limited to the design presented. Pre-assembled plates 10 can also be used for applications other than the described ones. Steel rods 19 can also be prevented from joining with the concrete of pre-assembled plate 10 in the last segment in a variety of ways. Combinations of the individual features are of course also within the protective scope of the invention.

That which is claimed:

1. A pre-assembled structural unit, which when adjoined at a jobsite with other like units via joints will form a roadway for a high-speed rail line, the structural unit having its longest dimension extending in a longitudinal direction, the structural unit having been prefabricated before it reaches the jobsite where it is to be disposed above a carrier layer of the roadway and beneath the rails on which high-speed vehicles travel above the roadway, each such structural unit comprising:

a unitary plate of concrete, the plate defining a first front side and a second front side disposed spaced apart from the first front side and generally parallel to the first front side, the plate defining a length dimension extending in the longitudinal direction between said first and second front sides, the plate defining a width dimension extending in a direction transverse to the longitudinal direction, the plate defining a thickness dimension extending in a direction perpendicular to both the longitudinal and transverse directions and parallel to the direction exerted by the force of gravity on the plate when the plate is disposed in use as part of the roadway for the high-speed rail line;

the plate defining a top and a generally flat bottom, the top being spaced apart from the bottom by the thickness dimension of the plate and further away from the source of the gravitational force on the plate when the plate is disposed in use as part of the roadway for the high-speed rail line;

the top defining a first dummy joint forming a shallow first groove that extends through the top of the plate but fails to extend continuously from the top to the bottom of the plate and thus forms a first dummy joint extending in the transverse direction, the first dummy joint being spaced in a longitudinal direction from said first front side by a first distance, the top defining a second dummy joint therein forming a shallow second groove that extends through the top of the plate but fails to extend continuously from the top to the bottom of the plate and thus forms a second dummy joint extending in a transverse direction, the second dummy joint being spaced in a longitudinal direction from said second front side by a second distance;

at least one steel rod extending in the longitudinal direction completely through the plate, said at least one steel rod defining an intermediate section having opposed first and second ends, said at least one steel rod defining a first covered portion that is connected to and extends longitudinally from the first end of the intermediate section, said at least one steel rod defining a first free end portion that is connected to and extends longitudinally from the first covered portion, said at least one steel rod defining a second covered portion that is connected to and extends longitudinally from the second end of the intermediate section, said at least one steel rod defining a second free end portion that is connected to and extends longitudinally from the second covered portion, the first free end portion projecting externally from the first front side of the plate, the first covered portion extending longitudinally within the plate from the first front side of the plate and toward the first groove for less than the first distance, the second free end portion projecting externally from the second front side of the plate, the second covered portion extending longitudinally within the plate from the second front side of the plate and toward the second groove for less than the second distance, the intermediate section being embedded in and contacting the plate along the entire length of the intermediate section and held fixed against movement relative to the plate, each of the first and second covered portions of the at least one rod being disposed within the plate without being in contact with the plate.

2. The unit according to claim 1, wherein each dummy joint forms a shallow groove that fails to extend continuously to the bottom of the plate and thus forms a dummy joint.

3. The unit according to claim 1, wherein said steel rods are not secured to said plate until at a location beginning approximately 50 cm removed longitudinally from the first front side of the pre-assembled plate.

4. A structural unit as in claim 1, further comprising:

a separate tube surrounding each covered portion of the one steel rod and having an outer surface fixed within the concrete plate, each tube surrounding the respective covered portion of the one steel rod and configured to permit elongation movement of the covered portion of the one steel rod relative to the concrete plate.

5. The unit according to claim 4, wherein each tube has a greater inside diameter than the outside diameter of the steel rod that the tube surrounds.

6. The unit according to claim 1, wherein each steel rod terminates in a recess defined by a front edge of the plate.

7. The unit according to claim 6 wherein the recess further defines an opening in communication with the top of the plate.

8. The unit according to claim 6 wherein the recess defines a lower wall which extends from said front edge a distance greater than an upper wall.

9. The unit according to claim 6 wherein the recess is further defined by an undercut when viewed from said upper surface.

10. The unit according to claim 6 wherein the recess forms a first joint with a corresponding recess of an adjacent plate.

11. The unit according to claim 10 wherein a bottom edge of the first front side runs substantially in a straight line and a top edge of the first front side has alternating first joints and second joints of varying width.

12. The unit according to claim 1, wherein the plate is produced from fiber concrete.

13. The unit according to claim 1, where the bottom of the plate is engaging a bituminous cement mortar.

14. The unit according to claim 13 wherein the bottom of said plate engages a sealing element selected from the group consisting of an elastomer, a sponge, a porous plastic and a neoprene mat.

15. A structural unit as in claim 1, further comprising:

a height adjusting device being carried by the plate, the height adjusting device being configured to selectively change the distance between the plate and the roadway's carrier layer disposed beneath the bottom of the plate.

16. A method of producing a compound plate construction of pre-assembled plates of reinforced concrete, as part of a permanent, longitudinally-extending roadway for high-speed rail vehicles, the longitudinal direction being the direction of the longest dimension of the roadway, the method comprising:

providing at least two pre-assembled plates disposed adjacent each other and above the roadway's carrier layer, each plate including reinforced concrete and defining a front side and having at least two steel rods extending in the longitudinal direction of the pre-assembled plate and projecting out of the front side of the plate, each said plate defining a top and defining in said top a first dummy joint extending transversely in said top and spaced apart from said front side a first distance, and each of said steel rods having a middle portion anchored in and contacting concrete in said plate and extending longitudinally beneath said dummy joint, and each of said rods having on each opposite side of said middle portion, a longitudinally extending free portion, each of said longitudinally extending free portions extending longitudinally from said front side of said plate toward said first dummy joint a distance less than said first distance and being surrounded by said concrete in said plate while being free from connection with said concrete in said plate, placing the adjacent pre-assembled plates so that the ends of the rods of each plate are in opposition and the adjacent plates are finely aligned, using a height adjusting device carried by said plates to adjust the height of said plates with respect to the roadway's carrier layer beneath said plates, pouring a substratum mass under each of the finely aligned and height-adjusted, pre-assembled plates, after the hardening of the substratum, forming a joint between the adjacent and finely aligned pre-assembled plates by connecting the opposed ends of the rods of the adjacent pre-assembled plates with tighteners and extending the free portions of the rods with the tighteners to effect a pre-tensioning of the connected and extended rods, and filling in the joint with sealing compound.

17. The method according to claim 16, wherein each adjacent pre-assembled plate is finely aligned by use of a spindle.

18. A method of producing a compound plate construction of pre-assembled plates of reinforced concrete, as part of a permanent, longitudinally-extending roadway for high-speed rail vehicles, comprising:

providing at least two pre-assembled structural units as in claim 1 disposed adjacent each other and above the roadway's carrier layer, placing the adjacent plates so that one of the first free end portions of the at least one steel rod of one plate is in opposition to one of the first free end portions of the at least one steel rod of the other plate and the adjacent plates are finely aligned, using a height adjusting device carried by the plates to adjust the height of the plates with respect to the roadway's carrier layer beneath the plates and with respect to each other, pouring a substratum mass under each of the finely aligned and height-adjusted plates, after the hardening of the substratum, forming a joint between the adjacent plates by connecting the opposed, free end portions of the rods of the adjacent plates with a tightener and extending the free end portions and respective covered portions of the rods with the tightener to effect a pre-tensioning of the rod of each plate, and filling in the joint with sealing compound.

* * * * *